United States Patent [19]

Budnick

[11] Patent Number: 4,998,726

[45] Date of Patent: Mar. 12, 1991

[54] ACCESSORY FOR GOLFERS

[76] Inventor: John Budnick, 204 Benjamin Franklin Hwy., Douglassville, Pa. 19518

[21] Appl. No.: 518,886

[22] Filed: May 4, 1990

[51] Int. Cl.[5] ..... A63B 57/00

[52] U.S. Cl. ..... 273/32 A; 273/32 B; 116/223; 172/371; 172/713

[58] Field of Search ..... 273/32 R, 32 A, 32 B, 273/32 H, 162 R, 162 A, 162 D, 162 F; 172/713, 371, 372, 378; 116/222, 223

[56] References Cited

U.S. PATENT DOCUMENTS

| | | | |
|---|---|---|---|
| 3,539,017 | 11/1970 | Johnson | 273/32 B |
| 4,535,987 | 8/1985 | Dikoff | 273/32 A |
| 4,922,850 | 5/1990 | Conley | 273/32 R |

*Primary Examiner*—George J. Marlo

*Attorney, Agent, or Firm*—Caesar, Rivise, Bernstein, Cohen & Pokotilow, Ltd.

[57] ABSTRACT

A light-weight, integrated, self-contained golf premium device to aid a golfer during a golf game comprising a generally rectangular two-piece case having a circular rotatable stroke counter, a retractable cleaning tool, a ball marker retainer and ball marker, an information display surface and an eyelet to secure the device to a key chain or golf bag. The two-piece case has a front and rear piece formed of a relatively rigid material which are fixedly secured to one another by conventional internal connecting elements. Each case piece has a generally planar wall with a peripheral edge, an upper and lower end, a first side and a second side. The peripheral edges of the front and rear pieces are adapted to cooperate with each other to form the eyelet and to form the case for holding the ball marker, the stroke counter and the retractable cleaning tool.

10 Claims, 2 Drawing Sheets

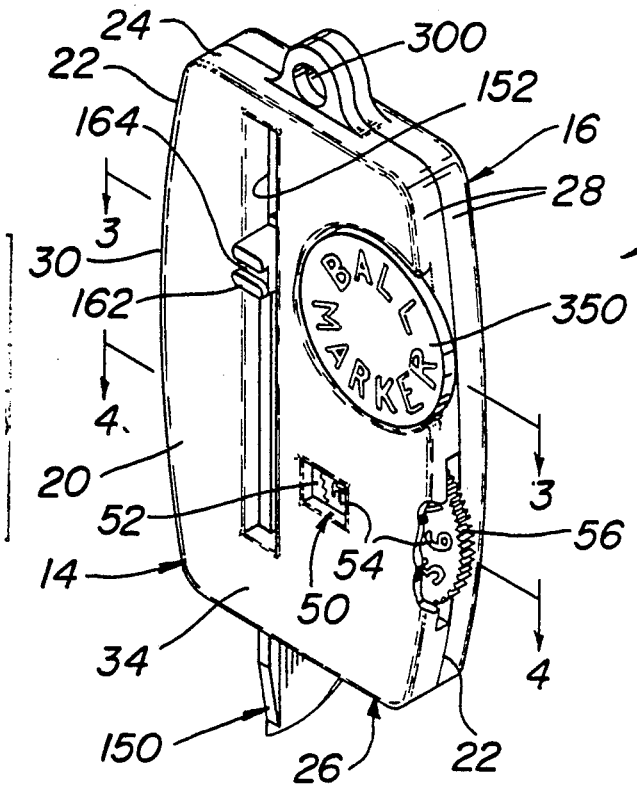
FIG. 1
FIG. 2
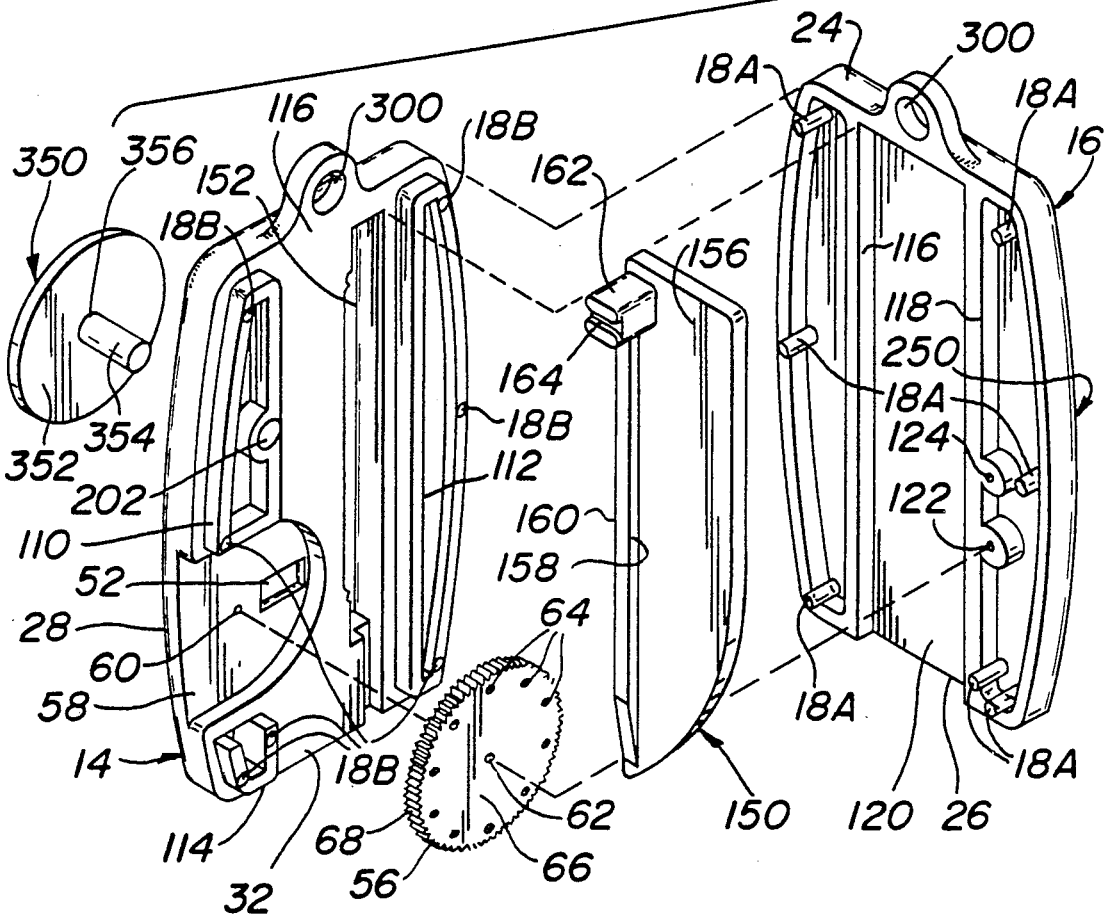

ACCESSORY FOR GOLFERS

BACKGROUND OF THE INVENTION

This invention relates generally to golf accessories and more specifically to a Golf Premium Device to aid a golfer while playing or practicing a game of golf.

While playing golf a golfer needs to have several small items such as a ball marker, a stroke counter and a cleaning tool readily available to assist the player. Oftentimes the golfer carries these items in his/her pocket while playing or stores them in a separate compartment of a golf bag. However, because these small items intermingle with other items in a player's pockets, they are often difficult to retrieve when needed. Additionally, a forgetful golfer might neglect to bring each of these items every time a game is played, or may lose or misplace the components while playing a game.

Prior art golf accessory devices include those found in U.S. Pat. Nos. 3,309,089 (Doyle), 3,310,879 (Brzezinski et al.), 4,151,937 (Jarosh et al.), 4,535,987 4,627,621 (Tate), (Dikoff), 4,736,877 (Clark), 4,475,676 (Smith), and 4,838,285 (Petrone).

OBJECTS OF THE INVENTION

Accordingly, it is a general object of this invention to provide a small device which can be conveniently carried by a golfer to contain golfing items which may be readily retrieved and used.

Another object of the present invention is to provide a device which permits a golfer to tally the number of golf strokes for a particular hole.

A further object of the present invention is to provide a device which holds a ball marker for easy removal and use.

It is yet still a further object of this invention to provide a device which contains a retractable resilient blade for the cleaning of golf cleats and club heads, as well as for the repair of divots.

Another object of this invention is to provide a light weight, inexpensive device which may be readily connected to a key chain or other object.

It is yet a further object of this invention to provide a device which permits identifying or promotional information to be easily applied to the display surface of the device.

SUMMARY OF THE INVENTION

These and other objects of this invention are achieved by providing a light-weight, integrated, self-contained golf premium device to aid a golfer during a golf game. The device is formed of a relatively rigid material and comprises a generally rectangular two-piece case containing a rotatable circular stroke counter, a retractable cleaning tool, a ball marker retainer and ball marker, an information display surface and an eyelet to connect the device to a key chain or other object.

The two-piece case has a front and rear piece which are fixedly secured to one another by internal male-female snapping connectors. Each of the two pieces has a generally planar exterior wall with a peripheral edge, an upper and lower end, and a first and second side. The peripheral edge of the front and rear pieces are adapted to cooperate with each other to form the eyelet and the case for holding the ball marker, the rotatable circular stroke counter and the retractable cleaning tool.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is a partially broken-away, three-dimensional view taken generally from the front of a device constructed in accordance with the present invention;

FIG. 2 is an exploded view of the device of FIG. 1;

DETAILED DESCRIPTION OF THE PREFERRED EMBODIMENTS

Figure 3:
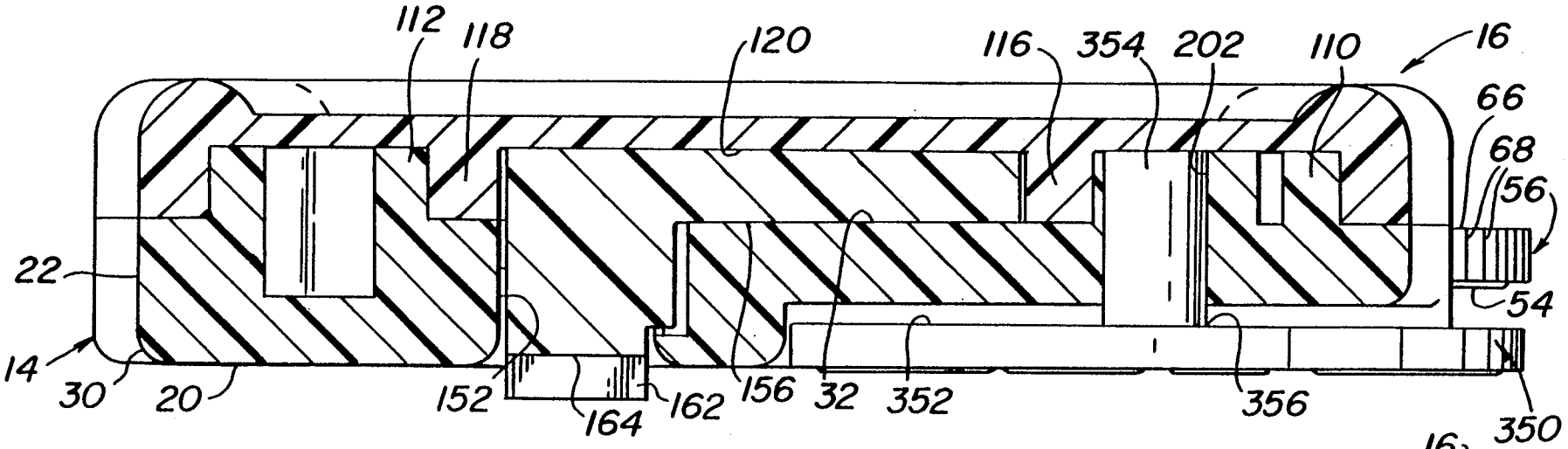
FIG. 3 is an enlarged cross-sectional view taken along line 3—3 in FIG. 1.

Referring now to various figures of the drawings where like reference numerals refer to like parts there is shown at 10 in FIG. 1, an embodiment of the device constructed in accordance with the present invention.

The small, light weight, integrated, self-contained device 10 comprises a generally rectangular two-piece case 12 having front piece 14 and rear piece 16, which houses a variety of components, all to be described in greater detail later. As shown in FIG. 2, the front piece 14 of the case 12 enables the user to access and/or actuate the rotatable circular stroke counter 50 for counting a golfer's strokes, the blade-shaped retractable cleaning tool 150 for cleaning golfing equipment or repairing divots, the ball marker 350 for marking a golf ball position on the ground, and the ball marker retainer 202 for releasably securing the ball marker 350. The case 12 also has a generally planar exterior surface on the rear piece 16 which functions as an informational display surface 250. The case 12 also has an eyelet 300 for connecting the case 12 to another object such as a key chain, as described later.

Although it is preferable that the case and all its components be comprised of a resilient material such as a generally rigid vinyl-based plastic, to minimize weight and production costs, it should be obvious to one skilled in the art that any suitable type materials may be utilized.

As shown more clearly in FIGS. 1 and 2, the generally rectangular two-piece case 12 comprises a front piece 14 and rear piece 16 which are fixedly secured to one another by an adhesive (not shown) or by conventional male 18A and female 18B snapping connectors molded on interior opposite sides of the pieces 14 and 16 as shown in FIG. 2.

Each of the pieces 14 and 16 possess a generally planar outer wall 20 having a peripheral edge 22, an upper end 24, a lower end 26, a first side 28 and a second side 30. The peripheral edges 22 of the front piece 14 and rear piece 16, are adapted to cooperate with each other to form the eyelet connector 300 and the case 12 which houses several of the moving parts of the device 10.

The front piece 14 of the case 12 comprises an interior surface 32 (FIG. 2) and an exterior 34 surface (FIG. 1) having several functional apertures as described below. An opening in surface 34 enables the golfer to view the numerals 54 on the rotatable circular stroke counter 50 through the window 52. A different opening enables retraction of the cleaning tool 150 by moving a guide element 162 along longitudinal slot 152. There is another opening to releasably retain the ball marker 350 in circular aperture 202.

The longitudinal slot 152 (FIG. 2) of the front exterior surface 34 is in communication with interior surface 32 and permits the golfer to slide the retractable cleaning tool 150 into and out of the case 12 by moving the generally rectangular guide element 162 along slot 152. An opening or window 52 in the front piece 14, enables the user to view the numerals 54 located on the rotatable circular stroke counter wheel 56 to be described in detail later. The ball marker retainer 200 is also located on the front piece 14 and comprises a circular aperture 202 for releasably securing the central stem 354 of the conventional ball marker 350 which protrudes from the center 356 of its circular flat surface 352. The conventional ball marker 350 temporarily marks a golf ball location on the putting green to enable another golfer to play through, without the ball obstructing the path of the hole.

The front interior surface 32 of the case 12, has an arcuate recess 58 extending through the top 28 of the case 12 and is used to house the circular stroke counting wheel 56 which the user rotates with his/her finger to count each successive golf stroke. The arcuate recess 58 has a central indent 60 for receiving and retaining the stem 62 of the stroke counter wheel 56, about which wheel 56 is rotatably advanced by the user to display the desired numeral (0 to 9) 54 through window 52.

The front interior surface 32 also has a first 110, second 112 and third 114 raised interior wall creating a longitudinal channel 116 therebetween and about the longitudinal slot 152 for slidably securing the retractable cleaning tool 154 which is generally knife-shaped. The interior wall 32 of the front piece 12 also has female receptacles 18B for receiving male connecting pins 18A located on the interior 36 of the rear piece 16 for fixedly securing the front 14 and rear piece 16 of the case 12 together by snapping the male connecting pins 18A into the female receptacles 18B.

The exterior surface 38 of the rear piece 16 of the case 12 comprises a generally planar information display surface 250 to receive information (not shown) thereon which may be applied by conventional hot stamping or by applying an adhesively secured label. The information placed on the display surface 250 is useful in identifying the owner of the device if lost, and/or enables an advertiser to apply promotional material thereon.

Figure 4:
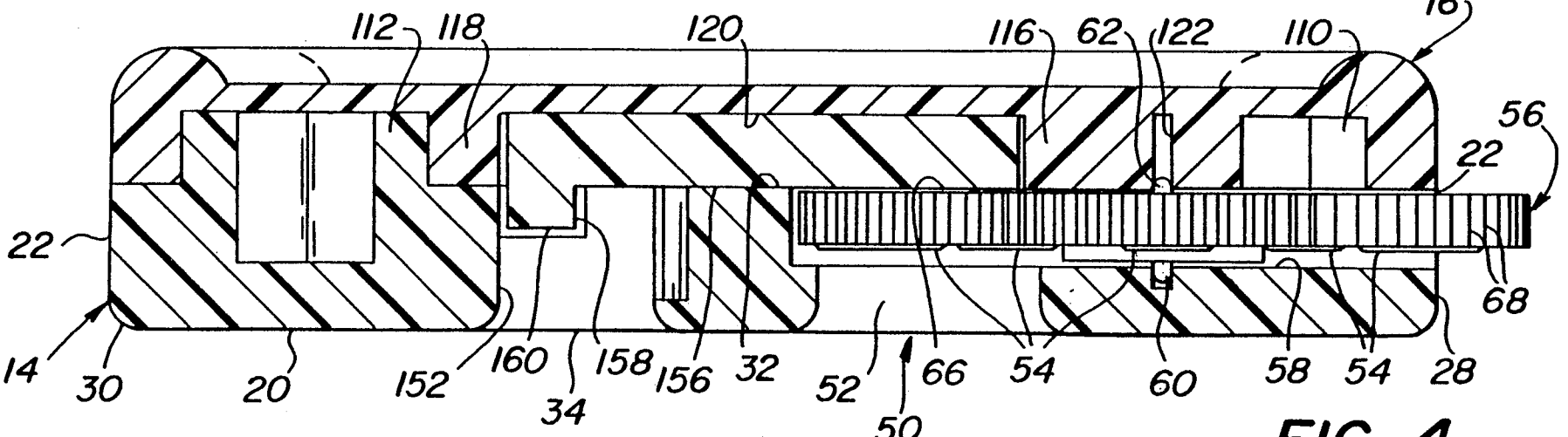
FIG. 4 is an enlarged cross-sectional view taken along line 4—4 in FIG. 1.

The rear interior surface 36 has a fifth 116 and sixth 118 raised interior wall adapted to cooperate with the first 112, second 114 and third 116 interior walls of the front interior surface 32, when the case 12 is assembled as shown in FIGS. 3 and 4. The fifth 116 and sixth 118 raised interior walls form the longitudinal channel 120 for slidably receiving the retractable knife 154.

Additionally, as shown in FIG. 2, the rear interior surface 36 comprises a raised circular indent 122 to receive the stem 62 of the circular stroke counting wheel 56, about which the wheel is rotated. The rear interior surface 36 also comprises a raised protrusion 124 for securing the wheel 56 of the stroke counter 50, so that the desired numeral 54 is displayed through window 52. The raised protrusion 124 is designed to frictionally engage the numeral indents 64 located on the rear surface 66 of the wheel 56 to prevent the wheel from rotating until desired. Each numeral 54 has a corresponding indent 64 on the rear surface 66 of the wheel 56. The wheel 56 also has a serrated or notched edge 68 which assists the user in rotating the wheel 56 with their finger or finger nail.

The retractable cleaning tool 150 comprises a blade portion 156 and a blade guide member 158 having a lateral raised guide wall 160 along one edge thereof and a generally rectangular guide element 162 to slidably protrude through the longitudinal slot 152 in the front piece 14 of the case 12. The guide element 162 has a notch 164 to assist the user in retracting the blade portion !56 by placing his/her finger nail or other object in the notch and moving the blade 156 in the desired direction. The cleaning tool 150 may be used to clean dirt or grass from between the cleats of a golfer's shoes, to repair divots on the golf course, or for any other suitable purpose.

The peripheral edges 22 of the front piece 14 and rear piece 16 cooperate with each other to form the generally circular eyelet connector 300 located on upper end 24. It should be readily apparent to those skilled in the art that the eyelet 300 may alternatively be located on only the front 14 or rear 16 piece in any desired location which does not obstruct the functions of the other elements of the device.

Without further elaboration the foregoing will so fully illustrate my invention that others may, by applying current or future knowledge, readily adapt the same for use under various conditions of service.

I claim:

1. A small, light weight, integrated, self-contained device for assisting a golfer in playing a game of golf, comprising a generally rectangular two-piece case having a circular stroke counter means for counting said golfer's strokes, retractable cleaning tool means for cleaning golfing equipment, ball marker means for marking a golf ball position on the ground, ball marker retaining means for releasably securing said ball marker means to said case, and information display means for displaying information on said case, said generally rectangular two-piece case comprising front and rear pieces formed of a relatively rigid material, said front and rear pieces being fixedly secured to one another by connection means for securing said front and rear pieces together, each of said pieces having a generally planar wall defined by a peripheral edge, an upper and a lower end, a first side and a second side, said peripheral edges of said front and rear pieces being adapted to cooperate with each other to form said case for holding said ball marker means, said stroke counting means and said retractable cleaning means.

2. The device of claim 1 wherein said front piece of said case has a front interior and exterior surface, and said rear piece has a rear interior and exterior surface, said front exterior surface having a first opening comprising a longitudinal slot in communication with said front interior surface for sliding said retractable cleaning means into and out of said case, a second opening formed in said front interior surface for viewing said stroke counting means, ball marker retaining means comprising an arcuate recess for receiving said ball marker means having a circular flat surface and a central stem, and a third opening in communication with said front interior surface for receiving said stem of said ball marker means into the interior of said case, said front interior surface having an arcuate recess extending through said top of said case and a central indent for receiving and retaining said stroke counting means, a first, second and third raised interior wall creating a longitudinal channel therebetween and about said longitudinal slot for slidably securing said retractable cleaning means, a blade retaining means in communication with said longitudinal slot for slidably securing said retractable cleaning tool means, said blade retaining means comprising a longitudinal slot in communication with the exterior of said lower end of said case, and holes for receiving securing pins located on the interior of said rear piece for fixedly securing said front and said rear piece of said case together, said rear exterior surface comprising a generally planar information display surface to receive information thereon, said rear interior surface comprising a generally planar wall having a peripheral edge from which at least one sidewall projects, said at least one sidewall being adapted to cooperate with said first, second and third interior walls of said front interior surface to form said case, a fifth and sixth raised interior wall forming a longitudinal channel therebetween, for slidably receiving said retractable cleaning tool means, a raised circular indent adjacent said sixth raised interior wall for securing said stroke counting means, a raised protrusion adjacent said sixth raised interior wall for securing said stroke counting means, and connecting pin means extending from said peripheral sidewall for fixedly securing said front piece to said rear piece.

3. The device of claim 2 wherein said retractable cleaning tool means comprises a blade portion and a blade guide member having a lateral raised guide wall along one edge thereof and a generally rectangular notched guide element to slidably protrude through said longitudinal slot in said front piece of said case.

4. The device of claim 3 wherein said retractable cleaning means is made of plastic.

5. The device of claim 2 wherein said stroke counting means comprises a flat circular digit wheel having a front side, a rear side and a serrated circumferential edge, said front side having a front central protrusion and numerals located about the circumference of said flat circular digit wheel, said rear side comprising a rear central protrusion and circular indentations located about the circumference of said flat circular digit wheel for receiving said raised protrusions of said rear interior surface for securing said stroke counting means in the desired position.

6. The device of claim 5 wherein said stroke counting means is made of plastic.

7. The device of claim 2 wherein said case is made of plastic.

8. The device of claim 1 wherein said case additionally comprises an eyelet.

9. The device of claim 8 wherein said eyelet is secured to said upper end of said case.

10. The device of claim 1 wherein said case is made of plastic.

* * * * *